US007147815B2

(12) United States Patent
Chang et al.

(10) Patent No.: US 7,147,815 B2
(45) Date of Patent: Dec. 12, 2006

(54) POLY(TRIMETHYLENE TEREPHTHALATE) BICOMPONENT FIBER PROCESS

(75) Inventors: Jing C. Chang, Boothwyn, PA (US); Ray W. Miller, Kennett Square, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 322 days.

(21) Appl. No.: 10/607,252

(22) Filed: Jun. 26, 2003

(65) Prior Publication Data

US 2004/0222544 A1 Nov. 11, 2004

Related U.S. Application Data

(60) Provisional application No. 60/436,082, filed on Dec. 23, 2002.

(51) Int. Cl.
*B29C 47/06* (2006.01)

(52) U.S. Cl. ..... 264/172.11; 264/172.13; 264/172.14; 264/172.15; 264/172.17

(58) Field of Classification Search ..... None
See application file for complete search history.

(56) References Cited

U.S. PATENT DOCUMENTS

| | | | | |
|---|---|---|---|---|
| 3,405,098 | A * | 10/1968 | Heighton et al. | 528/308.5 |
| 3,454,460 | A | 7/1969 | Bosley | |
| 3,671,379 | A | 6/1972 | Evans et al. | |
| 4,410,473 | A | 10/1983 | Iohara et al. | |
| 4,454,196 | A | 6/1984 | Iohara et al. | |
| 5,015,789 | A | 5/1991 | Arntz et al. | |
| 5,276,201 | A | 1/1994 | Haas et al. | |
| 5,284,979 | A | 2/1994 | Haas et al. | |
| 5,334,778 | A | 8/1994 | Haas et al. | |
| 5,340,909 | A | 8/1994 | Doerr et al. | |
| 5,364,984 | A | 11/1994 | Arntz et al. | |
| 5,364,987 | A | 11/1994 | Haas et al. | |
| 5,391,263 | A | 2/1995 | Hepner et al. | |
| 5,434,239 | A | 7/1995 | Bhatia | |
| 5,504,122 | A | 4/1996 | Michel et al. | |
| 5,510,454 | A | 4/1996 | Stouffer et al. | |
| 5,532,333 | A | 7/1996 | Stouffer et al. | |
| 5,532,404 | A | 7/1996 | Gallagher | |
| 5,540,868 | A | 7/1996 | Stouffer et al. | |
| 5,633,018 | A | 5/1997 | Stouffer et al. | |
| 5,633,362 | A | 5/1997 | Nagarajan et al. | |
| 5,677,415 | A | 10/1997 | Bhatia | |
| 5,686,276 | A | 11/1997 | Laffend et al. | |
| 5,710,315 | A | 1/1998 | Gallangher | |
| 5,714,262 | A | 2/1998 | Stouffer et al. | |
| 5,730,913 | A | 3/1998 | Stouffer et al. | |
| 5,763,104 | A | 6/1998 | Stouffer et al. | |
| 5,774,074 | A | 6/1998 | Cooper et al. | |
| 5,786,443 | A | 7/1998 | Lowe | |
| 5,798,433 | A | 8/1998 | Schmidt et al. | |
| 5,811,496 | A | 9/1998 | Iwasyk et al. | |
| 5,821,092 | A | 10/1998 | Nagarajan et al. | |
| 5,830,982 | A | 11/1998 | Stouffer et al. | |
| 5,840,957 | A | 11/1998 | Kurian et al. | |
| 5,856,423 | A | 1/1999 | Bhatia | |
| 5,962,745 | A | 10/1999 | Brossmer et al. | |
| 5,990,265 | A | 11/1999 | Blanchard et al. | |
| 6,235,948 | B1 | 5/2001 | Sunkara et al. | |
| 6,245,844 | B1 | 6/2001 | Kurian et al. | |
| 6,255,442 | B1 | 7/2001 | Kurian et al. | |
| 6,277,289 | B1 | 8/2001 | Kurian et al. | |
| 6,281,325 | B1 | 8/2001 | Kurian et al. | |
| 6,306,499 | B1 | 10/2001 | Ochi et al. | |
| 6,312,805 | B1 | 11/2001 | Sun | |
| 6,325,945 | B1 | 12/2001 | Kurian et al. | |
| 6,331,264 | B1 | 12/2001 | Kurian et al. | |
| 6,335,421 | B1 | 1/2002 | Kurian et al. | |
| 6,350,895 | B1 | 2/2002 | Kurian | |
| 6,353,062 | B1 | 3/2002 | Giardino et al. | |
| 6,372,343 | B1 | 4/2002 | Yamada et al. | |
| 6,555,220 | B1 | 4/2003 | Koyanagi et al. | |
| 6,641,916 | B1 * | 11/2003 | Chang et al. | 428/373 |
| 2001/0055683 | A1 | 12/2001 | Ochi et al. | |
| 2002/0071951 | A1 | 6/2002 | Hernandez et al. | |
| 2002/0107348 | A1 | 8/2002 | Giardino et al. | |
| 2003/0050429 | A1 * | 3/2003 | Kato et al. | 528/272 |
| 2003/0065105 | A1 * | 4/2003 | Kato et al. | 525/418 |
| 2003/0083441 | A1 | 5/2003 | Sun et al. | |
| 2003/0111171 | A1 * | 6/2003 | Casey et al. | 156/296 |
| 2004/0001950 | A1 | 1/2004 | Chang et al. | |
| 2004/0013877 | A1 * | 1/2004 | Nadkarni | 428/373 |
| 2004/0084796 | A1 * | 5/2004 | Chang et al. | 264/103 |
| 2004/0222544 | A1 * | 11/2004 | Chang et al. | 264/103 |

FOREIGN PATENT DOCUMENTS

| | | |
|---|---|---|
| EP | 0 201 114 A1 | 12/1986 |
| EP | 0 847 960 A1 | 6/1998 |
| JP | 10331075 A | 12/1998 |

(Continued)

OTHER PUBLICATIONS www.dictionary.com—definition of the term "altering". Source: American Heritage Dictionary, 2000.*

Hansjörg Ludwig Traub, Synthesis and Textile Chemical Properties of Polytrimethyleneterephthalate, German Institutes for Textile and Fiber Research Stuttgart Institute for Chemical Fibers, Feb. 7, 1994, pp. 1-90.

(Continued)

*Primary Examiner*—Mark Eashoo
(74) *Attorney, Agent, or Firm*—Mark D. Kuller; Bart E. Lerman

(57) ABSTRACT

A process for the preparation of a side-by-side or eccentric sheath-core bicomponent fiber wherein each component comprises a different poly(trimethylene terephthalate) composition.

25 Claims, 2 Drawing Sheets

FOREIGN PATENT DOCUMENTS

| | | | |
|---|---|---|---|
| JP | 11222730 | A | 8/1999 |
| JP | 2001055673 | A | 2/2001 |
| JP | 2001064828 | A | 3/2001 |
| JP | 2000239927 | A | 2/2002 |
| WO | WO 99/03809 | | 1/1999 |

OTHER PUBLICATIONS

S. Schauhoff, Degussa AG, Hanau/D, W. Schmidt, Zimmer AG, Frankfurt/D, New Developments in the Production of Polytrimethylene Terephthalate (PTT), Sep. 1996, 2 pages. Fiber Raw Materials.

* cited by examiner

POLY(TRIMETHYLENE TEREPHTHALATE) BICOMPONENT FIBER PROCESS

This application relates to and claims priority benefits from U.S. Provisional Patent Application Ser. No. 60/436,082, filed Dec. 23, 2002.

FIELD OF THE INVENTION

This invention relates to bicomponent poly(trimethylene terephthalate) fibers and processes for the manufacture thereof.

BACKGROUND OF THE INVENTION

Poly(trimethylene terephthalate) (also referred to as "3GT" or "PTT") has recently received much attention as a polymer for use in textiles, flooring, packaging and other end uses. Textile and flooring fibers have excellent physical and chemical properties.

It is known that bicomponent fibers wherein the two components have differing degrees of orientation, as indicated by differing intrinsic viscosities, possess desirable crimp contraction properties which lead to increased value in use for said fibers.

U.S. Pat. Nos. 3,454,460 and 3,671,379 disclose bicomponent polyester textile fibers. Neither reference discloses bicomponent fibers, such as sheath-core or side-by-side fibers, wherein each of the two components comprises the same polymer, e.g. poly(trimethylene terephthalate), differing in physical properties.

WO 01/53573 A1 discloses a spinning process for the production of side-by-side or eccentric sheath-core bicomponent fibers, the two components comprising poly(ethylene terephthalate) and poly(trimethylene terephthalate), respectively. Due to the poly(ethylene terephthalate) fibers and fabrics made from them have a harsher hand than poly (trimethylene terephthalate) monocomponent fibers and fabrics. In addition, due to the poly(ethylene terephthalate) these fibers and their fabrics require high-pressure dying.

U.S. Pat. No. 4,454,196 and 4,410,473, which are incorporated herein by reference, describe a polyester multifilament yarn consisting essentially of filament groups (I) and (II). Filament group (I) is composed of polyester selected from the group poly(ethylene terephthalate), poly(trimethylene terephthalate) and poly(tetramethylene terephthalate), and/or a blend and/or copolymer comprising at least two members selected from these polyesters. Filament group (II) is composed of a substrate composed of (a) a polyester selected from the group poly(ethylene terephthalate), poly (trimethylene terephthalate) and poly(tetramethylene terephthalate), and/or a blend and/or copolymer comprising at least two members selected from these polyesters, and (b) 0.4 to 8 weight % of at least one polymer selected from the group consisting of styrene type polymers, methacrylate type polymers and acrylate type polymers. The filaments can be extruded from different spinnerets, but are preferably extruded from the same spinneret. It is preferred that the filaments be blended and then interlaced so as to intermingle them, and then subjected to drawing or draw-texturing. The Examples show preparation of filaments of type (II) from poly(ethylene terephthalate) and polymethylmethacrylate (Example 1) and polystyrene (Example 3), and poly(tetramethylene terephthalate) and polyethylacrylate (Example 4). Poly(trimethylene terephthalate) was not used in the examples. These disclosures of multifilament yarns do not include a disclosure of multicomponent fibers.

JP 11-189925, describes the manufacture of sheath-core fibers comprising poly(trimethylene terephthalate) as the sheath component and a polymer blend comprising 0.1 to 10 weight %, based on the total weight of the fiber, polystyrene-based polymer as the core component. According to this application, processes to suppress molecular orientation using added low softening point polymers such as polystyrene did not work. (Reference is made to JP 56-091013 and other patent applications.) It states that the low melting point polymer present on the surface layer sometimes causes melt fusion when subjected to a treatment such as false-twisting (also known as "texturing"). Other problems mentioned included cloudiness, dye irregularities, blend irregularities and yarn breakage. According to this application, the core contains polystyrene and the sheath does not. Example 1 describes preparation of a fiber with a sheath of poly (trimethylene terephthalate) and a core of a blend of polystyrene and poly(trimethylene terephthalate), with a total of 4.5% of polystyrene by weight of the fiber.

JP 2002-56918A discloses sheath-core or side-by-side bicomponent fibers wherein one side (A) comprises at least 85 mole % poly(trimethylene terephthalate) and the other side comprises (B) at least 85 mole % poly(trimethylene terephthalate) copolymerized with 0.05–0.20 mole % of a trifunctional comonomer; or the other side comprises (C) at least 85 mole % poly(trimethylene terephthalate) not copolymerized with a trifunctional comonomer wherein the inherent viscosity of (C) is 0.15 to 0.30 less than that of (A). It is disclosed that the bicomponent fibers obtained were pressure dyed at 130° C.

It is desired to prepare fibers which have excellent stretch, a soft hand and excellent dye uptake, and which can be spun at high-speeds and dyed under atmospheric pressure.

It is also desired to increase productivity in the manufacture of side-by-side or eccentric sheath core poly(trimethylene terephthalate) bicomponent fibers by using higher speed spinning process, without deterioration of the filament and yarn properties.

SUMMARY OF THE INVENTION

According to a first aspect in accordance with the present invention a process comprises:

(a) providing two poly(trimethylene terephthalate) melts, (b) altering the intrinsic viscosity of at least one of said polymers such that after alteration, said polymers have intrinsic viscosities that differ by at least about 0.03 dL/g;

(c) providing the two poly(trimethylene terephthalate) melts to a spinnerette, and (d) spinning bicomponent fiber from the poly(trimethylene terephthalate) melts.

In a preferred aspect of the present invention, the two poly(trimethylene terephthalate) polymer melts are prepared by (a) providing two different remelt systems; and (b) remelting a poly(trimethylene terephthalate) in each of the remelt systems, wherein at least one of the remelt systems is operated so as to provide the poly(trimethylene terephthalate) melts having intrinsic viscosities that differ by at least about 0.03 dL/g Preferably, the viscosity of the poly(trimethylene terephthalate) in one of the remelt systems is decreased, preferably by at least about 0.03 dL/g. Alternatively, the viscosity of the poly(trimethylene terephthalate) in one of the remelt systems is increased, preferably by at least about 0.03 dL/g.

According to a further aspect in accordance with the present invention, at least one of the following is used to alter the intrinsic viscosity of a poly(trimethylene terephthalate) in one of the remelt systems:

(a) poly(trimethylene terephthalate) water content;

(b) melt temperature; and (c) melt residence time.

Preferably, the intrinsic viscosities of the poly(trimethylene terephthalate) melts, after altering, differ by at least about 0.03 to about 0.5 dL/g.

The fibers made in accordance with the present invention can take various shapes. The fibers can be sheath-core in shape. Preferably, the fibers are side-by-side or eccentric sheath core. Also preferably, the fibers are island-in-the-sea or pie-shaped.

In accordance with another aspect in accordance with the present invention, the side-by-side or eccentric sheath-core bicomponent fibers are in the form of partially oriented multifilament yarn.

In accordance with a further aspect in accordance with the present invention, a process for preparing bicomponent self-crimping yarn comprising poly(trimethylene terephthalate) bicomponent filaments comprises:

(a) providing two poly(trimethylene terephthalate) melts, (b) altering the intrinsic viscosity of at least one of said polymers such that after alteration, said polymers have intrinsic viscosities that differ by at least about 0.03 dL/g;

(c) providing the two poly(trimethylene terephthalate) melts to a spinnerette, (d) spinning bicomponent fiber from the poly(trimethylene terephthalate) melts, wherein the fibers are side-by-side or eccentric sheath-core fibers in the form of a partially oriented multifilament yarn, (e) winding the partially oriented yarn on a package, (f) unwinding the yarn from the package, (g) drawing the bicomponent filament yarn to form a drawn yarn, (h) annealing the drawn yarn, and (i) winding the yarn onto a package.

In yet another aspect in accordance with the present invention, the process further comprises drawing, annealing and cutting the fibers into staple fibers.

In yet a further aspect in accordance with the present invention, a process for preparing poly(trimethylene terephthalate) self-crimped bicomponent staple fiber comprises:

(a) providing two poly(trimethylene terephthalate)s;

(b) altering the intrinsic viscosity of at least one of said polymers such that after alteration, said polymers have intrinsic viscosities that differ by at least about 0.03 dL/g;

(c) melt-spinning the poly(trimethylene terephthalate)s from a spinneret to form at least one bicomponent fiber having either a side-by-side or eccentric sheath-core cross-section;

(d) passing the fiber through a quench zone below the spinneret;

(e) drawing the fiber at a temperature of about 50 to about 170° C. at a draw ratio of about 1.4 to about 4.5;

(f) heat-treating the drawn fiber at about 110 to about 170° C.;

(g) optionally interlacing the filaments; and (h) winding-up the filaments.

In yet a further aspect in accordance with the present invention a process for preparing poly(trimethylene terephthalate) self-crimped bicomponent staple fiber comprises:

(a) providing two poly(trimethylene terephthalate)s;

(b) altering the intrinsic viscosity of at least one of said polymers such that after alteration, said polymers have intrinsic viscosities that differ by at least about 0.03 dL/g;

(c) melt-spinning the compositions through a spinneret to form at least one bicomponent fiber having either a side-by-side or eccentric sheath-core cross-section;

(d) passing the fiber through a quench zone below the spinneret;

(e) optionally winding the fibers or placing them in a can; drawing the fiber;

(g) heat-treating the drawn fiber; and (h) cutting the fibers into about 0.5 to about 6 inches staple fiber.

Preferably each component comprises at least about 95% of poly(trimethylene terephthalate), by weight of the polymer in the component.

Preferably each of the poly(trimethylene terephthalate)s contains at least 95 mole % tri(methylene terephthalate) repeat units.

In yet another embodiment in accordance with the present invention, a process for preparing poly(trimethylene terephthalate) self-crimped bicomponent staple fiber comprises:

(a). providing two different poly(trimethylene terephthalate)s differing in intrinsic viscosity by about 0.03 to about 0.5 dl/g, (b). melt-spinning the compositions through a spinneret to form at least one bicomponent fiber having either a side-by-side or eccentric sheath-core cross-section;

(c). passing the fiber through a quench zone below the spinneret;

(d). optionally winding the fibers or placing them in a can;

(e). drawing the fiber;

(f). heat-treating the drawn fiber; and (g). cutting the fibers into about 0.5 to about 6 inches staple fiber, wherein the two different poly(trimethylene terephthalate)s are prepared by (i) providing two different remelt systems; and (ii) remelting a poly(trimethylene terephthalate) in each of the remelt systems, wherein at least one of the remelt systems is operated so as to provide the poly(trimethylene terephthalate) melts having intrinsic viscosities that differ by at least about 0.03 dL/g.

DETAILED DESCRIPTION OF THE INVENTION

Figure 1:
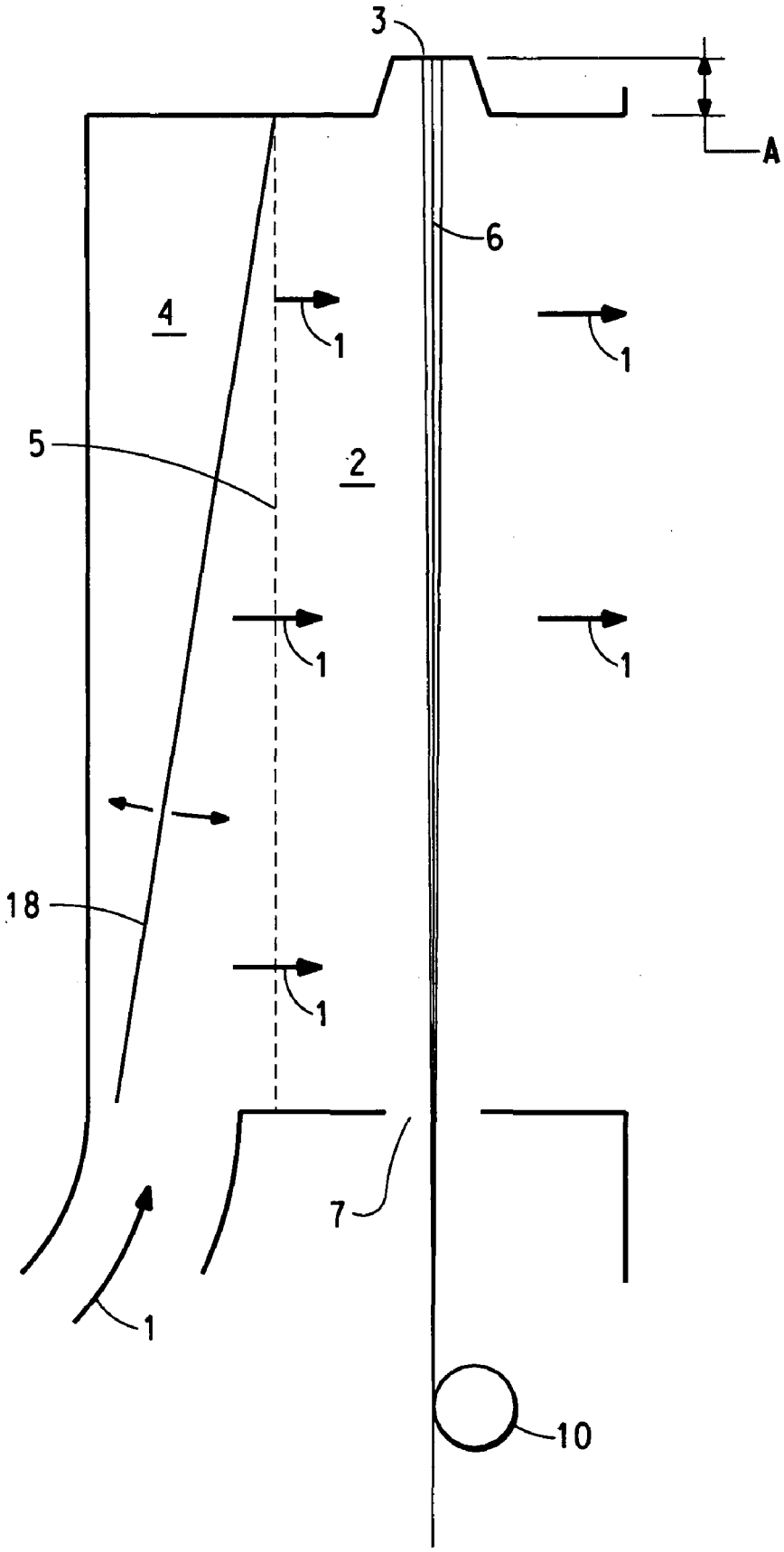
FIG. 1 illustrates a cross-flow quench melt-spinning apparatus useful in the preparation of the products of the present invention.

This invention is directed to a process for preparing a poly(trimethylene terephthalate) bicomponent fiber comprising:

(a) providing two poly(trimethylene terephthalate) melts, (b) altering the intrinsic viscosity of at least one of said polymers such that after alteration, said polymers have intrinsic viscosities that differ by at least about 0.03 dL/g;

(c) providing the two poly(trimethylene terephthalate) melts to a spinnerette, and (d) spinning bicomponent fiber from the poly(trimethylene terephthalate) melts.

Preferably, the two poly(trimethylene terephthalate) polymer melts are prepared by (a) providing two different remelt systems; and (b) remelting a poly(trimethylene terephthalate) in each of the remelt systems, wherein at least one of the remelt systems is operated so as to provide the poly(trimethylene terephthalate) melts having intrinsic viscosities that differ by at least about 0.03 dL/g.

In a typical operation, poly(trimethylene terephthalate) polymer material, typically in the form of flake, is fed to two extruders from one or more feed hoppers. The poly(trimethylene terephthalate) is heated and ultimately melted in the extruders, then fed through two separate metering pumps to a spinning block wherein the bicomponent fiber is formed. The process of the present invention is practiced in one or more locations from the feed hopper on through to the spinning die.

The poly(trimethylene terephthalate) polymer material that is fed to each remelt system may be the same or different. That is, identical poly(trimethylene terephthalate) polymer material may be fed to each remelt system and the difference in IV in the poly(trimethylene terephthalate) components in the ultimately resulting bicomponent fiber results solely from the operation of the remelt systems.

Alternatively, two different poly(trimethylene terephthalate) polymer materials, already differing in IV, may be fed to the two remelt systems, and the operation of the remelt systems may be controlled to increase (or decrease) this preexisting IV difference in order to prepare the bicomponent fiber with the desired degree of difference in IV between the poly(trimethylene terephthalate) components.

It is noted that the initial difference in intrinsic viscosity of the two polymers could be less than (e.g. the same IV) or greater than 0.03 dL/g, as long as after altering the intrinsic viscosity of at least one of the polymers, the difference in IV is at least about 0.03 dL/g. By way of non-limiting illustration, in the instance of a first polymer having an IV lower than the IV of a second polymer and the difference in IV is less than 0.03 dL/g, it would be within the scope of the present invention to achieve a difference in IV of at least about 0.03 dL/g by (1) decreasing the IV of the first polymer, (2) increasing the IV of the first polymer, (3) decreasing the IV of the second polymer, (4) increasing the IV of the second polymer or (4) altering the IV of both polymers.

The variables (parameters) in the operation of the remelt/spinning systems that are varied in the practice of the process of the present invention include remelt temperature, residence time of the remelted polymer materials in the remelt system, and the moisture level (water content), or adjusted moisture level, of the remelted polymers.

Poly(trimethylene terephthalate) of a given IV typically exhibits a lowering (decrease) of IV when remelted. The higher the remelt temperature to which the poly(trimethylene terephthalate) is exposed, the greater the decrease in IV. In the practice of the present invention, remelt temperatures in the range of about 235° C. to about 295° C. may be employed. Operation in the higher temperature ranges, 275° C. to 295° C., must be closely monitored due to very rapid IV changes in that temperature range. A preferred temperature range is from about 235° C. to 270° C. Remelt temperatures are typically measured and controlled in the extruder. However, the temperature in any transfer line, feed pump, or melt holdup tank may be advantageously varied in the practice of the process of the present invention.

Residence time of the remelted polymer in the remelt systems prior to spinning is typically controlled by the physical setup of the remelt/spinning equipment. The equipment may be arranged to gain the desired residence times and any desired difference in residence times between the two remelt systems. Alternatively, metering pumps, optionally employed melt holdup tanks or recycle loops may be employed to furnish variable holdup times in the same equipment. Longer holdup times correlate with a lowered IV of the resulting polymer. In practice, in laboratory equipment holdup times ranging from about 1 to about 7 minutes were employed. In production scale equipment, holdup times of from about 10 to about 20 minutes are expected to be utilized. In the practice of the present invention, total holdup time from the time the poly(trimethylene terephthalate) polymer material is remelted, through any transfer lines and equipment, up until the time of fiber formation may be controlled.

Moisture content of the polymer to be remelted also affects IV, and changes in IV, during the remelt/spinning operation. The higher the moisture level of the starting polymer, the greater the decrease in IV observed through the remelt cycle. In addition to the moisture level (water content) of the starting polymer, moisture level may be changed by changing the operation of the system from the feed hopper through the extruder. In practice, the feed hopper-extruder system is purged/blanketed with an inert gas, typically nitrogen, in order to minimize polymer degradation. This inert gas blanket/purge may be controlled and varied with respect to gas volume, velocity, temperature and moisture content to yield a corresponding change in the moisture content of the polymer. Further, it may be desirable to introduce water, optionally in the form of water vapor, at the point where polymer flake is introduced to the extruder, or in the barrel of the extruder, to increase water content of the polymer.

In the practice of this invention in a remelt/spinning system comprising two remelt systems it is customary to hold the operation of one remelt system constant and achieve differences in IV by varying the operation of the other. It is however within the scope of this invention to vary both of the two remelt systems independently.

The practice of the process of the present invention allows the control of the difference in IV in the poly(trimethylene terephthalate) components in the ultimately resulting bicomponent fiber. In general, the greater the difference in IV between the two components, the greater the crimp contraction and, hence, the greater the value of the resulting bicomponent fiber.

Further, the practice of the present invention allows increased fiber quality in that the control parameters of the process allow greater uniformity of product.

Further, the practice of the process allows for increased efficiencies of operation through potentially reduced inventories of starting material. By the operation of the process of the present invention, a wide variety of bicomponent fibers, wherein the difference between the two poly(trimethylene terephthalate) components differs by varying amounts, may be manufactured using a minimum of differing IV starting materials. In the ultimate simplification, as indicated above, bicomponent fibers wherein the fiber components have different IV's may be made from a single poly(trimethylene terephthalate) starting material.

As used herein, "bicomponent fiber" means a fiber comprising a pair of polymers intimately adhered to each other along the length of the fiber, so that the fiber cross-section is for example a side-by-side, eccentric sheath-core or other suitable cross-sections from which useful crimp can be developed.

In the absence of an indication to the contrary, a reference to "poly(trimethylene terephthalate)" ("3GT" or "PTT"), is meant to encompass homopolymers and copolymers containing at least 70 mole % trimethylene terephthalate repeat units and polymer compositions containing at least 70 mole % of the homopolymers or copolyesters. The preferred poly(trimethylene terephthalate)s contain at least 85 mole %, more preferably at least 90 mole %, even more preferably at least 95 or at least 98 mole %, and most preferably about 100 mole %, trimethylene terephthalate repeat units.

Examples of copolymers include copolyesters made using 3 or more reactants, each having two ester forming groups. For example, a copoly(trimethylene terephthalate) can be used in which the comonomer used to make the copolyester is selected from the group consisting of linear, cyclic, and branched aliphatic dicarboxylic acids having 4–12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 2–8 carbon atoms (other than 1,3-propanediol, for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic ether glycols having 4–10 carbon atoms (for example, hydroquinone bis(2-hydroxyethyl) ether, or a poly (ethylene ether) glycol having a molecular weight below about 460, including diethyleneether glycol). The comonomer typically is present in the copolyester at a level in the range of about 0.5 to about 15 mole %, and can be present in amounts up to 30 mole %.

The poly(trimethylene terephthalate) can contain minor amounts of other comonomers, and such comonomers are usually selected so that they do not have a significant adverse effect on properties. Such other comonomers include 5-sodium-sulfoisophthalate, for example, at a level in the range of about 0.2 to 5 mole %. Very small amounts of trifunctional comonomers, for example trimellitic acid, can be incorporated for viscosity control.

The poly(trimethylene terephthalate) can be blended with up to 30 mole percent of other polymers. Examples are polyesters prepared from other diols, such as those described above. The preferred poly(trimethylene terephthalate)s contain at least 85 mole %, more preferably at least 90 mole %, even more preferably at least 95 or at least 98 mole %, and most preferably about 100 mole %, poly(trimethylene terephthalate).

The intrinsic viscosity of the poly(trimethylene terephthalate) used in the invention ranges from about 0.60 dL/g up to about 2.0 dL/g, more preferably up to 1.5 dL/g, and most preferably up to about 1.2 dL/g. Preferably the poly (trimethylene terephthalates) have a difference in IV of at least about 0.03 more preferably at least about 0.10 dL/g, and preferably up to about 0.5 dL/g, more preferably up to about 0.3 dL/g.

Poly(trimethylene terephthalate) and preferred manufacturing techniques for making poly(trimethylene terephthalate) are described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,235,948, 6,245,844, 6,255,442, 6,277,289, 6,281,325, 6,312,805, 6,325,945, 6,331,264, 6,335,421, 6,350,895, and 6,353,062, EP 998 440, WO 00/14041 and 98/57913, H. L. Traub, "Synthese und textilchemische Eigenschaften des Poly-Trimethylene-terephthalats", Dissertation Universitat Stuttgart (1994), S. Schauhoff, "New Developments in the Production of Poly (trimethylene terephthalate) (PTT)", Man-Made Fiber Year Book (September 1996), and U.S. patent application Ser. No. 10/057,497, all of which are incorporated herein by reference. Poly(trimethylene terephthalate)s useful as the polyester of this invention are commercially available from E. I. du Pont de Nemours and Company, Wilmington, Del., under the trademark Sorona.

The poly(trimethylene terephthalate) can also be an acid-dyeable polyester composition as described in U.S. patent application Ser. No. 09/708,209, filed Nov. 8, 2000 (corresponding to WO 01/34693) or 09/938,760, filed Aug. 24, 2002, both of which are incorporated herein by reference. The poly(trimethylene terephthalate)s of U.S. patent application Ser. No. 09/708,209 comprise a secondary amine or secondary amine salt in an amount effective to promote acid-dyeability of the acid dyeable and acid dyed polyester compositions. Preferably, the secondary amine unit is present in the composition in an amount of at least about 0.5 mole %, more preferably at least 1 mole %. The secondary amine unit is present in the polymer composition in an amount preferably of about 15 mole % or less, more preferably about 10 mole % or less, and most preferably 5 mole % or less, based on the weight of the composition. The acid-dyeable poly(trimethylene terephthalate) compositions of U.S. patent application Ser. No. 09/938,760 comprise poly(trimethylene terephthalate) and a polymeric additive based on a tertiary amine. The polymeric additive is prepared from (i) triamine containing secondary amine or secondary amine salt unit(s) and (ii) one or more other monomer and/or polymer units. One preferred polymeric additive comprises polyamide selected from the group consisting of poly-imino-bisalkylene-terephthalamide, -isophthalamide and -1,6-naphthalamide, and salts thereof. The poly(trimethylene terephthalate) useful in this invention can also be cationically dyeable or dyed composition such as those described in U.S. Pat. No. 6,312,805, which is incorporated herein by reference, and dyed or dye-containing compositions.

Other polymeric additives can be added to the poly (trimethylene terephthalate), to improve strength, to facilitate post extrusion processing or provide other benefits. For example, hexamethylene diamine can be added in minor amounts of about 0.5 to about 5 mole % to add strength and processability to the acid dyeable polyester compositions of the invention. Polyamides such as nylon 6 or nylon 6-6 can be added in minor amounts of about 0.5 to about 5 mole % to add strength and processability to the acid-dyeable polyester compositions of the invention. A nucleating agent, preferably 0.005 to 2 weight % of a mono-sodium salt of a dicarboxylic acid selected from the group consisting of monosodium terephthalate, mono sodium naphthalene dicarboxylate and mono sodium isophthalate, as a nucleating agent, can be added as described in U.S. Pat. No. 6,245,844, which is incorporated herein by reference.

The poly(trimethylene terephthalate) polymer can, if desired, contain additives, e.g., delusterants, nucleating agents, heat stabilizers, viscosity boosters, optical brighteners, pigments, and antioxidants. $TiO_2$ or other pigments can be added to the poly(trimethylene terephthalate), the composition, or in fiber manufacture. (See, e.g., U.S. Pat. Nos. 3,671,379, 5,798,433 and 5,340,909, EP 699 700 and 847 960, and WO 00/26301, which are incorporated herein by reference.)

Alternative Styrene Embodiment

In an alternative embodiment, the poly(trimethylene terephthalate) may contain as additive a styrene polymer. By "styrene polymer" is meant polystyrene and its derivatives. Preferably the styrene polymer is selected from the group consisting of polystyrene, alkyl or aryl substituted polystyrenes and styrene multicomponent polymers, more preferably polystyrenes. Most preferably, the styrene polymer is polystyrene.

The styrene polymer, if present, is preferably present in a component in an amount of at least about 0.1%, more preferably at least about 0.5, and preferably up to about 10 weight %, more preferably up to about 5 weight %, and most preferably up to about 2 weight %, by weight of the polymers in the component.

Poly(trimethylene terephthalate)s can be prepared using a number of techniques. Preferably poly(trimethylene terephthalate) and the styrene polymer are melt blended and, then, extruded and cut into pellets. ("Pellets" is used generically in this regard, and is used regardless of shape so that it is used to include products sometimes called "chips", "flakes", etc.) The pellets are then remelted and extruded into filaments. The term "mixture" is used when specifically referring to the pellets prior to remelting and the term "blend" is used when referring to the molten composition (e.g., after remelting). A blend can also be prepared by compounding poly(trimethylene terephthalate) pellets with polystyrene during remelting, or by otherwise feeding molten poly (trimethylene terephthalate) and mixing it with styrene polymer prior to spinning.

The poly(trimethylene terephthalate)s preferably comprise at least about 70%, more preferably at least about 80%, even more preferably at least 85%, more preferably at least about 90%, most preferably at least about 95%, and in some cases even more preferably at least 98% of poly(trimethylene terephthalate), by weight of the polymers in the component. The poly(trimethylene terephthalate) preferably contains up to about 100 weight % of poly(trimethylene terephthalate), or 100 weight % minus the amount of styrene polymer present.

The poly(trimethylene terephthalate) composition preferably comprises at least about 0.1%, more preferably at least about 0.5%, of styrene polymer, by weight of the polymer in a component. The composition preferably comprises up to about 10%, more preferably up to about 5%, even more preferably up to about 3%, even more preferably up to 2%, and most preferably up to about 1.5%, of a styrene polymer, by weight of the polymer in the component. In many instances, preferred is about 0.8% to about 1% styrene polymer. Reference to styrene polymer means at least one styrene polymer, as two or more styrene polymers can be used, and the amount referred to is an indication of the total amount of styrene polymer(s) used in the polymer composition.

Discussion of Drawings

With reference now to the drawings, FIG. 1 illustrates a crossflow melt-spinning apparatus which is useful in the process of the invention. Quench gas 1 enters zone 2 below spinneret face 3 through plenum 4, past hinged baffle 18 and through screens 5, resulting in a substantially laminar gas flow across still-molten fibers 6 which have just been spun from capillaries (not shown) in the spinneret. Baffle 18 is hinged at the top, and its position can be adjusted to change the flow of quench gas across zone 2. Spinneret face 3 is recessed above the top of zone 2 by distance A, so that the quench gas does not contact the just-spun fibers until after a delay during which the fibers may be heated by the sides of the recess. Alternatively, if the spinneret face is not recessed, an unheated quench delay space can be created by positioning a short cylinder (not shown) immediately below and coaxial with the spinneret face. The quench gas, which can be heated if desired, continues on past the fibers and into the space surrounding the apparatus. Only a small amount of gas can be entrained by the moving fibers which leave zone 2 through fiber exit 7. Finish can be applied to the now-solid fibers by optional finish roll 10, and the fibers can then be passed to the rolls illustrated in FIG. 2.

Figure 2:
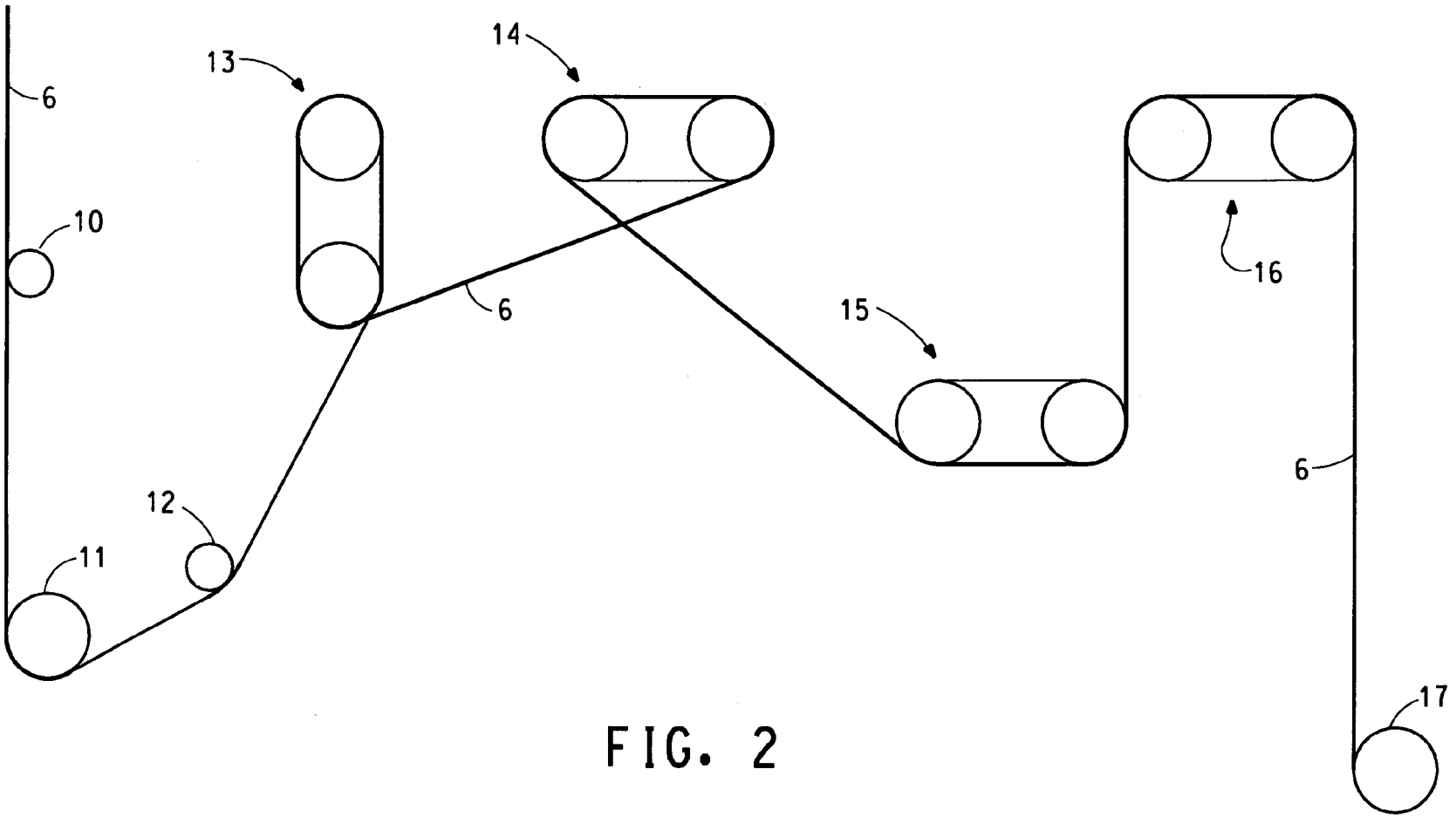
FIG. 2 illustrates an example of a roll arrangement that can be used in conjunction with the melt-spinning apparatus of FIG. 1.

In FIG. 2, fiber 6, which has just been spun for example from the apparatus shown in FIG. 1, can be passed by (optional) finish roll 10, around driven roll 11, around idler roll 12, and then around heated feed rolls 13. The temperature of feed rolls 13 can be in the range of about 50° C. to about 70° C. The fiber can then be drawn by heated draw rolls 14. The temperature of draw rolls 14 can be in the range of about 50 to about 170° C., preferably about 100° C. to about 120° C. The draw ratio (the ratio of wind-up speed to withdrawal or feed roll speed) is in the range of about 1.4 to about 4.5, preferably about 3.0 to about 4.0. No significant tension (beyond that necessary to keep the fiber on the rolls) need be applied between the pair of rolls 13 or between the pair of rolls 14.

After being drawn by rolls 14, the fiber can be heat-treated by rolls 15, passed around optional unheated rolls 16 (which adjust the yarn tension for satisfactory winding), and then to windup 17. Heat treating can also be carried out with one or more other heated rolls, steam jets or a heating chamber such as a "hot chest". The heat-treatment can be carried out at substantially constant length, for example, by rolls 15 in FIG. 2, which heat the fiber to a temperature in the range of about 110° C. to about 170° C., preferably about 120° C. to about 160° C. The duration of the heat-treatment is dependent on yarn denier; what is important is that the fiber can reach substantially the same temperature as that of the rolls. If the heat-treating temperature is too low, crimp can be reduced under tension at elevated temperatures, and shrinkage can be increased. If the heat-treating temperature is too high, operability of the process becomes difficult because of frequent fiber breaks. It is preferred that the speeds of the heat-treating rolls and draw rolls be substantially equal in order to keep fiber tension substantially constant at this point in the process and thereby avoid loss of fiber crimp.

Alternatively, the feed rolls can be unheated, and drawing can be accomplished by a draw-jet and heated draw rolls which also heat-treat the fiber. An interlace jet optionally can be positioned between the draw/heat-treat rolls and windup.

Finally, the fiber is wound up. A typical wind up speed in the manufacture of the products of the present invention is 3,200 meters per minute (mpm). The range of usable wind up speeds is about 2,000 mpm to 6,000 mpm.

EXAMPLES

The following examples are presented for the purpose of illustrating the invention, and are not intended to be limiting. All parts, percentages, etc., are by weight unless otherwise indicated.

Intrinsic Viscosity

The intrinsic viscosity (IV) was determined using viscosity measured with a Viscotek Forced Flow Viscometer Y900 (Viscotek Corporation, Houston, Tex.) for the polymers dissolved in 50/50 weight % trifluoroacetic acid/methylene chloride at a 0.4 grams/dL concentration at 19° C. following an automated method based on ASTM D 5225-92. The measured viscosity was then correlated with standard viscosities in 60/40 wt % phenol/, 1,2,2-tetrachloroethane as determined by ASTM D 4603-96 to arrive at the reported intrinsic values. IV of the polymers in the fiber was determined on actually spun bicomponent fiber or, alternatively, IV of the polymers in the fiber was measured by exposing polymer to the same process conditions as polymer actually spun into bicomponent fiber except that the test polymer was spun without a pack/spinneret such that the two polymers were not combined into a single fiber.

Tenacity and Elongation at Break

The physical properties of the poly(trimethylene terephthalate) yarns reported in the following examples were measured using an Instron Corp. tensile tester, model no. 1122. More specifically, elongation to break, $E_b$, and tenacity were measured according to ASTM D-2256.

Crimp Contraction

Unless otherwise noted, the crimp contraction in the bicomponent fiber made as shown in the Examples was measured as follows. Each sample was formed into a skein of 5000+/−5 total denier (5550 dtex) with a skein reel at a tension of about 0.1 gpd (0.09 dN/tex). The skein was conditioned at 70+/−° F. (21+/−1° C.) and 65+/−2% relative humidity for a minimum of 16 hours. The skein was hung substantially vertically from a stand, a 1.5 mg/den (1.35 mg/dtex) weight (e.g. 7.5 grams for 5550 dtex skein) was hung on the bottom of the skein, the weighted skein was allowed to come to an equilibrium length, and the length of the skein was measured to within 1 mm and recorded as "Cb". The 1.35 mg/dtex weight was left on the skein for the duration of the test. Next, a 500 mg weight (100 mg/d; 90 mg/dtex) was hung from the bottom of the skein, and the length of the skein was measured within 1 mm and recorded as "Lb". Crimp contraction value (percent) (before heatsetting, as described below for this test), "CCb", was calculated according to the formula:

$$CCb=100\times(Lb-Cb)/Lb$$

The 500 g weight was removed and the skein was then hung on a rack and heatset, with the 1.35 mg/dtex weight still in place, in an oven for 5 minutes at about 212° F. (100° C.), after which the rack and skein were removed from the oven and conditioned as above for two hours. This step is designed to simulate commercial dry heat-setting, which is one way to develop the final crimp in the bicomponent fiber. The length of the skein was measured as above, and its length was recorded as "Ca". The 500-gram weight was again hung from the skein, and the skein length was measured as above and recorded as "La". The after heat-set crimp contraction value (%), "CCa", was calculated according to the formula $$CCa=100\times(La-Ca)/La$$

CCa is reported in the tables.

Fiber Preparation

Poly(trimethylene terephthalate), having intrinsic viscosities as shown in Table 1, were spun using the apparatus of FIG. 1. The starting poly(trimethylene terephthalate)s were dried to less than 50 ppm water content. The spinneret temperature was maintained at less than 265° C. The (post-coalescence) spinneret was recessed into the top of the spinning column by 4 inches (10.2 cm) ("A" in FIG. 1) so that the quench gas contacted the just-spun fibers only after a delay.

In spinning the bicomponent fibers in the examples, the polymer was melted with Werner & Pfleiderer co-rotating 28-mm extruders having 0.5–40 pound/hour (0.23–18.1 kg/hour) capacities. The highest melt temperatures attained in the poly(trimethylene terephthalate) (3GT) extruder was about 265–275° C. Pumps transferred the polymers to the spinning head.

The fibers were wound up with a Barmag SW6 2s 600 winder (Barmag AG, Germany), having a maximum winding speed of 6000 mpm.

The spinneret used was a post-coalescence bicomponent spinneret having thirty-four pairs of capillaries arranged in a circle, an internal angle between each pair of capillaries of 30°, a capillary diameter of 0.64 mm, and a capillary length of 4.24 mm. Unless otherwise noted, the weight ratio of the two polymers in the fiber was 50/50. The quench was carried out using apparatus similar to FIG. 1. The quench gas was air, supplied at room temperature of about 20° C. The fibers had a side-by-side cross-section.

In the Examples, the draw ratio applied was about the maximum operable draw ratio in obtaining bicomponent fibers. Unless otherwise indicated, rolls 13 in FIG. 2 were operated at about 70° C., rolls 14 at about 90° C. and 3200 mpm and rolls 15 at about 120° C. to about 160° C.

Example 1

Spinning was carried out as described above using the conditions described in Table I.

TABLE I

| Chip IV* | | Fiber IV* | | Delta IV* | Draw | Rolls 15 | | Tenacity | | |
|---|---|---|---|---|---|---|---|---|---|---|
| West | East | West | East | West-East | Ratio | ° C. | Denier | (g/d) | Elongation | CCa(%) |
| 1.01 | 0.86 | 0.96 | 0.70 | 0.26 | 2.4 | 160 | 95 | 3.2 | 21 | 43.7 |
| 1.01 | 0.86 | 0.96 | 0.74 | 0.22 | 2.5 | 160 | 98 | 3.1 | 22 | 35.6 |
| 1.01 | 0.86 | 0.98 | 0.80 | 0.18 | 2.5 | 160 | 104 | 3.3 | 22 | 18.5 |
| 1.01 | 0.86 | 0.96 | 0.83 | 0.13 | 2.6 | 160 | 103 | 3.5 | 25 | 7.3 |

*As measured, dL/g.

The data show that increased crimp contraction (CCa) can be attained as the difference in intrinsic viscosity (IV) is increased between West extruder and East extruder. Fiber IV of the West extruder was maintained constant while fiber IV of the East extruder was changed by changing the polymer melt temperatures and melt residence time as shown in Table 2.

TABLE 2

| Chip IV East | Fiber IV East | Extruder zone temp ° C. | transfer line temp ° C. | spin pack temp ° C. | Residence time min |
|---|---|---|---|---|---|
| 0.86 | 0.70 | 270 | 267 | 255 | 8.4 |
| 0.86 | 0.74 | 270 | 262 | 250 | 8.4 |
| 0.86 | 0.80 | 260 | 252 | 250 | 4.8 |
| 0.86 | 0.83 | 250 | 247 | 255 | 2.9 |

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the disclosure.

What is claimed is:

1. A process for preparing a poly(trimethylene terephthalate) bicomponent fiber comprising:

(a) providing two poly(trimethylene terephthalate) melts, (b) altering the intrinsic viscosity of at least one of said polymers such that after alteration, said polymers have intrinsic viscosities that differ by at least about 0.03 dL/g;

(c) providing the two poly(trimethylene terephthalate) melts to a spinnerette, and (d) spinning bicomponent fiber from the poly(trimethylene terephthalate) melts, wherein the two poly(trimethylene terephthalate) polymer melts are prepared by (i) providing two different remelt systems; and (ii) remelting a poly(trimethylene terephthalate) in each of the remelt systems, wherein at least one of the remelt systems is operated so as to provide the poly(trimethylene terephthalate) melts having intrinsic viscosities that differ by at least about 0.03 dL/g.

2. The process of claim 1, wherein at least one of the following is used to alter the intrinsic viscosity of a poly (trimethylene terephthalate):

(a) poly(trimethylene terephthalate) water content;

(b) melt temperature; and (c) melt residence time.

3. The process of claim 1, wherein in (b) the intrinsic viscosity of at least one polymer is decreased.

4. The process of claim 1, wherein in (b) the intrinsic viscosity of at least one polymer is increased.

5. The process of claim 1 wherein the intrinsic viscosities of the poly(trimethylene terephthalate) melts differ by at least about 0.03 to about 0.5 dL/g.

6. The process of claim 5, wherein the intrinsic viscosities of the poly(trimethylene terephthalate) melts differ by at least about 0.03 to about 0.3 dL/g.

7. The process of claim 1 wherein the intrinsic viscosity of the poly(trimethylene terephthalate) in one of the remelt systems is lowered by at least about 0.03 dL/g.

8. The process of claim 1 wherein the intrinsic viscosity of the poly(trimethylene terephthalate) in one of the remelt systems is lowered by at least about 0.03 to about 0.5 dL/g.

9. The process of claim 8, wherein the intrinsic viscosities of the poly(trimethylene terephthalate) melts differ by at least about 0.03 to about 0.3 dL/g.

10. The process of claim 1, wherein the fibers are side-by-side or eccentric sheath-core fibers.

11. The process of claim 10, wherein the side-by-side or eccentric sheath-core bicomponent fibers are in the form of a partially oriented multifilament yarn.

12. The process of claim 1, wherein the fibers are sheath-core fibers.

13. The process of claim 1, wherein the fibers are island-in-the-sea or pie-shaped.

14. The process of claim 1, wherein the two polymer melts in (a) are the same.

15. The process of claim 1, wherein the two polymer melts in (a) are different.

16. The process of claim 1, wherein the poly(trimethylene terephthalate) bicomponent fiber comprises a copolymer with up to 30 mole % comonomer.

17. The process of claim 16, wherein the poly(trimethylene terephthalate) bicomponent fiber comprises a copolymer with about 0.5 to about 15 mole % comonomer.

18. The process of claim 17, wherein the copolymer comprises copolyester made using 3 or more reactants, each having two ester forming groups.

19. The process of claim 16, wherein the poly(trimethylene terephthalate) comprises a secondary amine, secondary amine salt, or tertiary amine in an amount effective to promote acid dyeability of the bicomponent fiber.

20. The process of claim 1, wherein the poly(trimethylene terephthalate) is blended with up to 30 mole % of other polymers.

21. The process of claim 1, wherein the poly(trimethylene terephthalate) comprises an acid-dyeable polyester composition.

22. The process of claim 1, wherein each component comprises at least about 95% of poly(trimethylene terephthalate), by weight, of the polymer in the component.

23. The process of claim 1, wherein each of the poly (trimethylene terephthalate)s contains at least 95 mole % trimethylene terephthalate repeat units.

24. The process of claim 1, wherein the remelt temperature is in the range of from about 235° C. to about 295° C.

25. The process of claim 24, wherein the remelt temperature is in the range of from about 235° C. to about 250° C.

* * * * *